US007011747B2

(12) United States Patent
Hodak

(10) Patent No.: US 7,011,747 B2
(45) Date of Patent: Mar. 14, 2006

(54) POOL SKIMMER ASSEMBLY

(76) Inventor: Jerry Hodak, 155 Zehner School Rd., Zelienople, PA (US) 16063

( * ) Notice: Subject to any disclaimer, the term of this patent is extended or adjusted under 35 U.S.C. 154(b) by 102 days.

(21) Appl. No.: 10/693,478

(22) Filed: Oct. 23, 2003

(65) Prior Publication Data

US 2005/0087482 A1 Apr. 28, 2005

(51) Int. Cl.
*E04H 4/14* (2006.01)

(52) U.S. Cl. ..... 210/169; 210/232; 210/416.2; 4/496

(58) Field of Classification Search ..... 210/169, 210/232, 416.1, 416.2; 4/496, 507
See application file for complete search history.

(56) References Cited

U.S. PATENT DOCUMENTS 3,508,661 A * 4/1970 Gershman et al. ..... 210/169
4,819,681 A 4/1989 Hodak
4,843,658 A 7/1989 Hodak
4,903,351 A 2/1990 Dengel et al.
4,913,810 A 4/1990 Hodak
5,194,162 A 3/1993 Hodak
5,285,538 A 2/1994 Hodak
5,388,567 A 2/1995 Hodak
5,604,939 A 2/1997 Widener
5,937,453 A 8/1999 Hodak et al.
5,948,245 A 9/1999 Hodak
6,226,938 B1 5/2001 Hodak
6,578,208 B1 6/2003 Lytle
6,701,542 B1 * 3/2004 Marbach ..... 4/507

* cited by examiner

*Primary Examiner*—Fred G. Prince
(74) *Attorney, Agent, or Firm*—Buchanan Ingersoll, P.C.

(57) ABSTRACT

A seal for a pool skimmer is provided. The seal is attached to the inner periphery of the faceplate, at the opening for fluid passage from the pool to the skimmer housing and filter assembly. In this manner, the surface of the seal is generally flush with the faceplate. Moreover, the fasteners which secure the faceplate and the skimmer housing to the pool sidewall remain accessible for later adjustment by the pool owner or pool service personnel with the seal securely in place.

20 Claims, 3 Drawing Sheets

POOL SKIMMER ASSEMBLY

BACKGROUND OF THE INVENTION

1. Field of the Invention

The present invention relates to a pool skimmer assembly, and more particularly to a faceplate seal for sealing a skimmer apparatus.

2. Description of the Prior Art

In recreational pools, such as swimming pools, spas or whirlpools, it is typical to use a pool cleaning apparatus that employs a skimmer. The skimmer housing is mounted to an outside surface of the sidewall of the pool and includes a filter means for cleaning the water within the pool after it is drawn through the skimmer. A faceplate is mounted to the inside surface of the pool and has a generally large opening that is sealed with respect to the inside surface of the pool wall and is generally located at the surface water level. The skimmer includes means for creating a vacuum within the housing so that the surface water continuously flows from the pool surface into the housing and then through the pool filtering equipment and then back into the pool by means of another opening or outlet port generally located below the surface level of the water.

The skimmer housing assembly is mounted behind the pool wall and the faceplate is fastened to the opposite surface of the pool wall, such as by screws that pass through the faceplate and the pool wall, and is threaded into the skimmer housing assembly. A gasket may be positioned between the faceplate and the pool wall for an additional watertight seal. In this manner, a seal is provided between the faceplate, the pool wall, and the skimmer housing.

During initial construction of the skimmer assembly, it is not uncommon for the screws that mount the faceplate to the pool to become loose a short time after initial installation. Periodically, the owner of the pool must retighten these fasteners in order to maintain the seal and to prevent leakage of water behind the skimmer faceplate and housing. Typically, this retightening procedure must occur during the winter months in the North, for example, when the pool has been covered-over for the winter months. Moreover, in order to prevent water from freezing within the skimmer assembly and damaging the typically plastic components due to expansion of the ice within the skimmer, the skimmer assembly must be evacuated to prevent the build-up of ice within the skimmer. Additionally, within many pools, it is important to maintain the level of water within the pool so as to provide support for the walls of an in-ground pool, for example.

In order to close off the opening of the skimmer, closure assemblies have been developed to cover the faceplate prior to the evacuation of water from the skimmer so that the level of water within the pool remains generally consistent with the level of the faceplate. However, the re-tightening procedure necessitates the owner removing the cover from the pool and accessing the screws around the outer periphery of the skimmer faceplate. Examples of such closure assemblies are shown in U.S. Pat. Nos. 4,913,810 and 5,937,453. However, if the pool owner needs to retighten the screws around the faceplate, these cover assemblies need to be removed in order to access the screws. Since these cover assemblies fit over the faceplates, and hence over the screws, it is necessary to remove the faceplate to access the screws. This then allows water to flow into the skimmer assembly during the cold winter months and requires re-evacuation of the skimmer.

What is needed, then, is a pool skimmer faceplate cover that completely seals off the skimmer, while allowing access to the screws for retightening by the pool owner.

It is therefore an object of the present invention to provide a pool skimmer assembly having a faceplate seal while allowing access to its fasteners.

It is another object of the present invention to provide a faceplate seal having improved sealing engagement.

SUMMARY OF THE INVENTION

In order to overcome these problems associated with the prior art, the pool skimmer assembly of the present invention is provided. In accordance with the above and other objects and advantages of the present invention, a pool skimmer assembly, for a pool having a sidewall with an opening therein, comprises a skimmer housing adapted to be mounted to an outside surface of the sidewall adjacent the pool opening so as to be in fluid communication with the pool. A faceplate is secured to an inside surface of the sidewall adjacent the skimmer opening, the faceplate further including an outer periphery and an inner periphery, the inner periphery being in fluid communication with the pool opening and the skimmer housing. A means for fastening the faceplate to the sidewall is provided such that the faceplate is sealingly secured to the inside surface of the sidewall. A skimmer seal sealingly engages the inner periphery of the faceplate whereby the skimmer housing is not in fluid communication with the pool.

BRIEF DESCRIPTION OF THE DRAWINGS

Various other objects, features and advantages of the present invention, in addition to the above, will become readily apparent to those skilled in the art, by reading the following detailed description in conjunction with the drawings, which are shown by way of example only, wherein.

DESCRIPTION OF THE PREFERRED EMBODIMENTS

Figure 1:
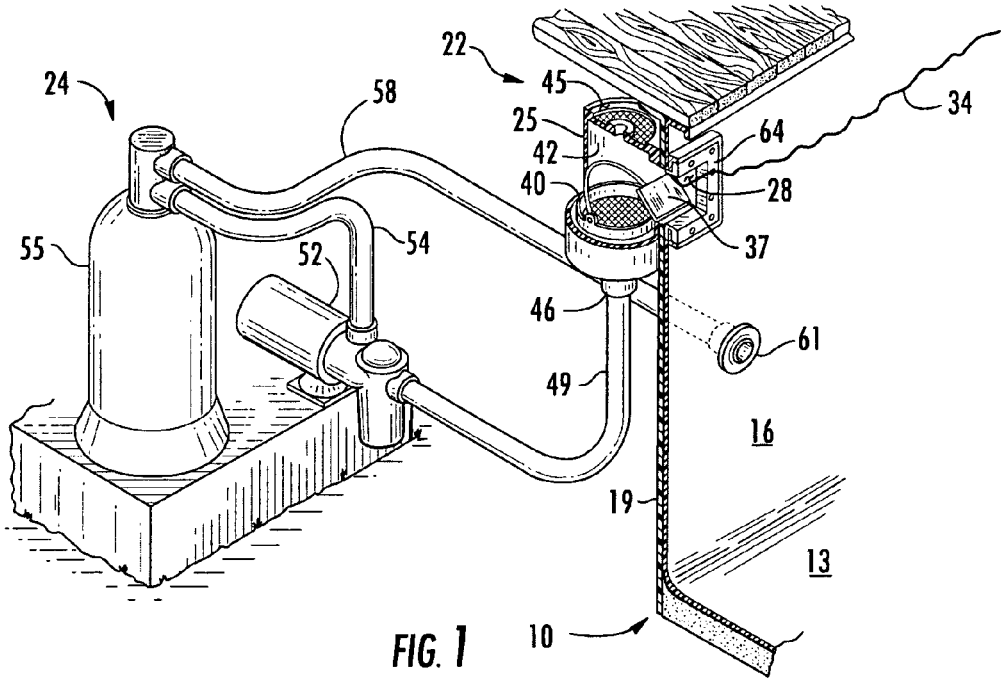
FIG. 1 is a prospective view of a skimmer apparatus operatively mounted to a swimming pool, in accordance with the present invention.
Figure 2:
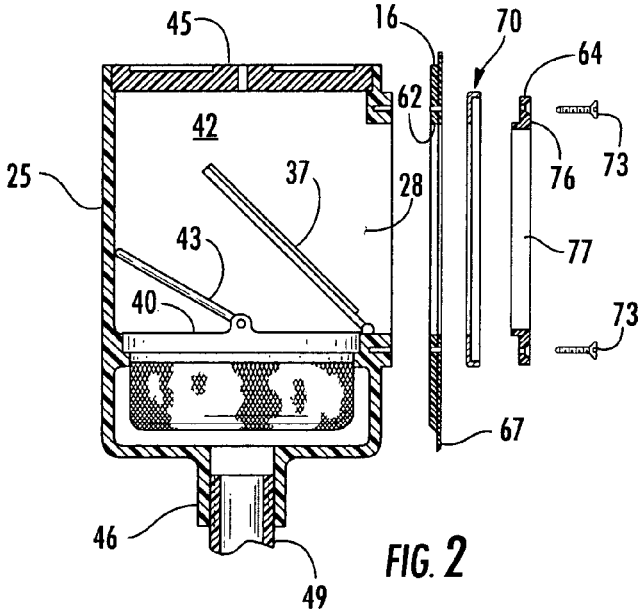
FIG. 2 is a perspective exploded view of a skimmer apparatus; shown in FIG. 1.

Referring now to the drawings in detail wherein like numerals refer to similar components within the figures, there is shown in FIG. 1 a conventional pool and skimmer assembly. Although described with respect to a recreational swimming pool 10, it will be appreciated that the skimmer assembly of the present invention could also be used with a whirlpool or spa of any shape and size. The pool includes a floor 13 and one or more sidewalls 16, depending upon the shape of the pool 10, such as oval, round, rectangular, etc. Mounted on the outside surface 19 of the sidewall 16 for the pool 10 is a skimmer assembly 22 that is operatively connected to a filter assembly 24. The filter assembly 24 can be mounted either above or below the surface level of the pool. The skimmer assembly 22 includes a housing 25 having an opening 28 in fluid communication with the water 34 in the pool 10, and may be covered by a pivotally mounted door 37 for providing access to the skimmer. A basket 40 for collecting debris within the housing collection chamber 42 has a handle 43 for periodic removal of the basket 40 and the debris by removing the housing lid 45. The skimmer assembly 22 has an outlet 46 that is connected to the filter assembly 24 by means of a pipe 49. The filter assembly 24 includes a pump 52 for creating a partial vacuum within the skimmer housing 25 and drawing water 34 from at or near the surface level of the pool 10 via the pump 52 and second conduit 54 into the filter unit 55 so as to clean the water. After passing through the filter unit 55, the cleaned water passes out a third conduit or pipe 58 to an inlet port 61 to return the cleaned water back to the pool 10, which port 61 is typically mounted adjacent to the skimmer assembly 22 below the surface level of the water 34.

In order to seal the opening 62 of the pool sidewall 16 at the area where the skimmer housing 25 is mounted, a faceplate 64 is mounted to the inside surface 67 of the pool wall 16 opposite the opening 28 of the skimmer housing 25. A gasket 70 may be mounted behind the faceplate 64 against the interior or inside surface 67 of the pool sidewall 16 in order to more effectively seal the opening 62 in the pool sidewall 16. The faceplate 64 is attached to the pool sidewall 16 and skimmer housing 22 by means of screws 73 or other types of fasteners that pass through the faceplate 64, optional gasket 70 and through corresponding openings within the pool sidewall 16 and into the skimmer housing 25. It will be readily appreciated that other fasteners, such as bolts and nuts, may be utilized.

Figure 3:
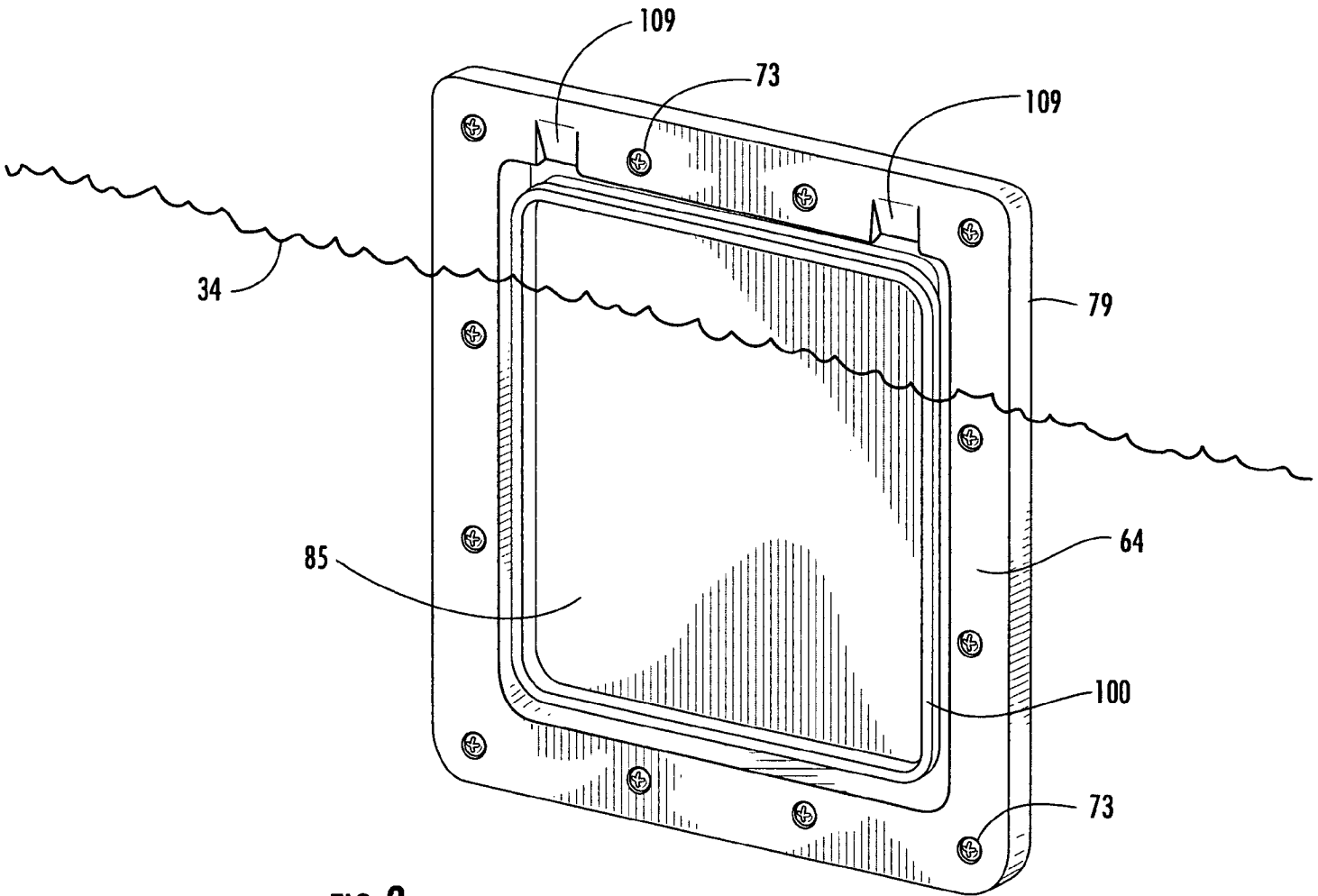
FIG. 3 is a plan view of a skimmer faceplate seal according to the teachings of the present invention.

As shown more fully in FIG. 3, the pool skimmer faceplate 64 is generally rectangular in shape, although it can be of any configuration, and projects slightly outward from the inside surface 67 of the pool sidewall 16. A plurality of screws 73 are threadingly engaged with the pool skimmer housing 25 after they pass through the corresponding openings within the faceplate 64, gasket 70 and pool sidewall 16 in order to secure the skimmer assembly 22 to the pool sidewall 16. The faceplate 64 has an inner periphery 76, defining a faceplate opening 77 for permitting passage of water 34 into the skimmer housing 25 and an outer peripheral edge 79. According to a preferred embodiment of the present invention (see FIG. 4), the inner periphery 76 of the pool skimmer faceplate 64 includes a generally C-shaped channel 82. This C-shaped configuration is adapted to engage the pool skimmer seal 85 according to the present invention.

Figure 4:
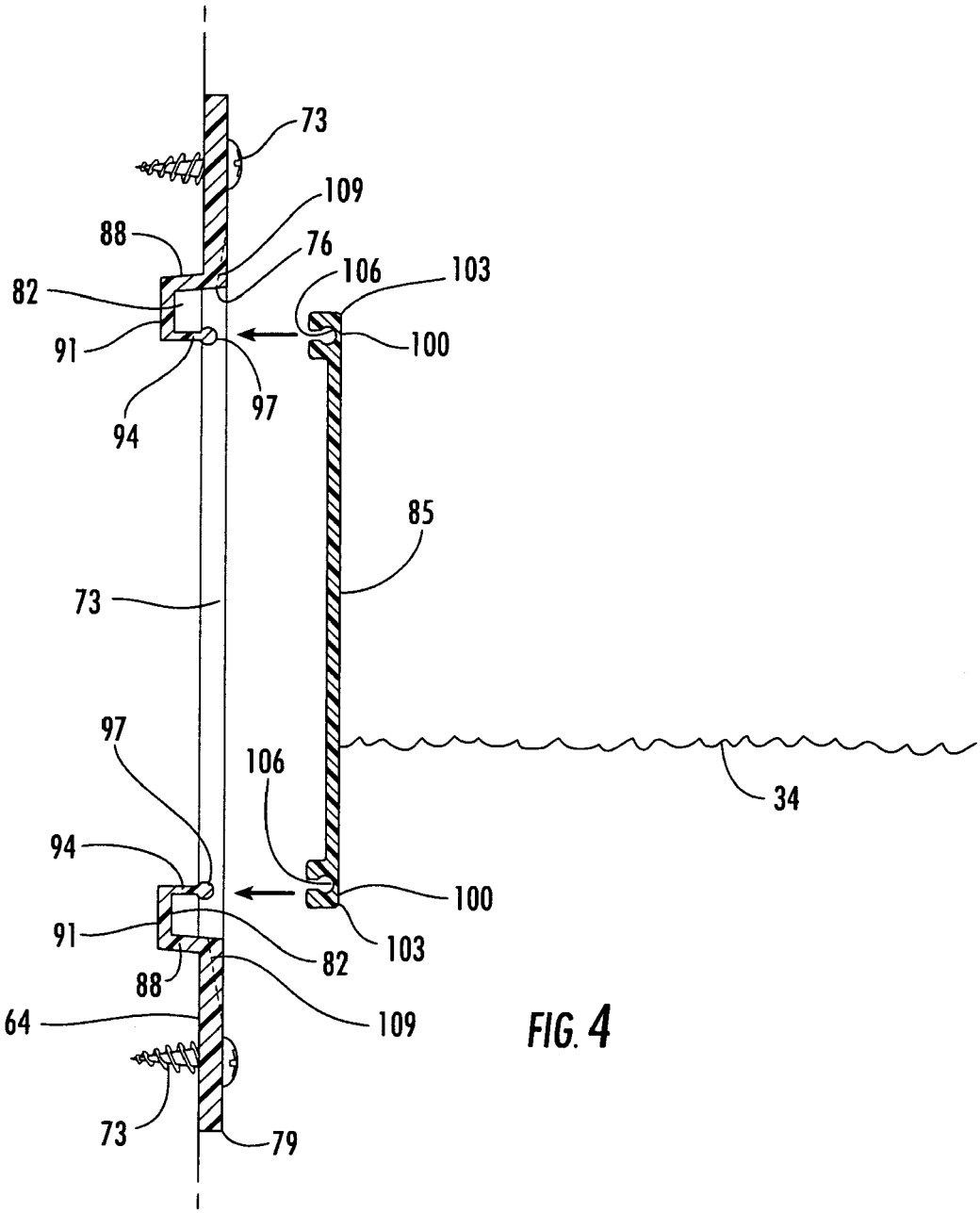
FIG. 4 is a cross-sectional side view showing the interaction of the pool skimmer seal assembly of the present invention with the faceplate shown in FIG. 3.

As shown in FIG. 4, the inner periphery 76 of the opening 77 for the faceplate 64 includes a first arm 88 which projects outward from the pool and towards the skimmer housing 25 then a second arm 91 perpendicular thereto projecting toward the opening, with a third arm 94 being perpendicular to the second arm 91 (and generally parallel to the first arm 88) and projecting back towards the interior of the pool 10. The third arm 94 also includes, preferably, a rounded portion 97 for sealingly engaging the pool skimmer seal 85 of the present invention. The pool skimmer seal 85 assembly comprises a generally flat sealing member or lid having a complimentary C-shaped portion 100 on its outer periphery 103 to sealingly engage the C-shaped inner periphery 76 of the pool skimmer faceplate 64. The outer periphery 103 of the pool skimmer seal 85 includes a rounded opening 106 which closely matches that of the faceplate 64 rounded portion 97 so as to provide a frictional engagement between the pool skimmer seal outer edge 103 and the inner periphery 76 of the pool skimmer faceplate 64. By utilizing rounded corners rather than 90° sealing edges as used in the prior art, the two sealing areas of the faceplate and the seal create a double seal to better ensure leak protection. Also, the outer periphery rounded opening 106 provides a recess into which an o-ring lubricant can be inserted to provide additional water-tightness.

Although the preferred embodiment of the present invention is described as having a C-shaped inner periphery 76, it will be appreciated by those skilled in the art that other shapes are possible. For example, a generally L-shaped periphery can be provided, such as by eliminating the first arm 88 so that the second arm 91 comprises an arm projecting downward from the inner periphery of the faceplate and the third arm comprises another arm projecting perpendicularly therefrom. Also, the inner periphery may be more circular rather than rectangular. So long as the third arm 94 is provided, and preferably having the rounded portion 97, for engaging the outer periphery 103 of the seal 85, any configuration of the faceplate 64 inner periphery 76 is possible and can be formed using conventional plastic molding and fabrication techniques.

With each of these configurations, when attached to the faceplate 64, the seal 85 is generally flush with the surface of the faceplate. This aids in preventing accidental removal of the seal 85 from the faceplate 64 in the event of ice build-up, for example, on the surface of the water 34.

In this manner, after the pool skimmer seal 85 is in place over the pool skimmer faceplate 64 (FIG. 4), the water can be evacuated from the pool skimmer housing 25 and any additional water is prevented from entering the skimmer by the seal 85 according to the present invention. Moreover, and perhaps more importantly, the fasteners 73 that mount the faceplate 64 to the pool sidewall 16 and skimmer housing 25 remain accessible for later tightening by the pool owner while the seal 85 remains in place. Contrasting with the prior art, the pool skimmer seal 85 does not have to be removed in order to access these screws 73, obviating a generally troublesome procedure for pool owners.

In order to remove the pool skimmer seal 85, such as in the spring months when the pool owner wants to re-open the pool, the faceplate 64 preferably comprises one or more notched areas 109 to facilitate the pool owner or pool service personnel in removing the pool skimmer seal 85. While the notched areas 109 provide a means by where a pool owner can grab the seal 85 along its outer edge 103, it may be more convenient to use a screwdriver, or other flat-faced tool, in order to pry the pool skimmer seal from the faceplate 64. Moreover, by sealing along the inner periphery of the faceplate 64, the sealing area is smaller than when sealing along its outer periphery, on the order 50% smaller. This reduction in seal length reduces the risk of leakage, amount of material needed to manufacture the seal 85, and reduces the ultimate price to the consumer.

An advantage of the present invention over the prior art is that the outer periphery 103 of the seal 85 of the present invention is "shielded" from any external forces engaging the seal 85, as is common with ice formations or other objects which may contract and remove typical seal assemblies which mount on the outer periphery 79 of the faceplate 64. Since the outer edge of the seal 85 fits within the C-shaped opening 82 of the faceplate 64, the outer peripheral edge 103 of the seal 85 is generally flush with the surface of the faceplate 64 and cannot easily bumped by another object that may inadvertently remove the seal 85 from the faceplate 64.

If the pool owner desires to provide a cover over the screws 73 during the winter months, the outer periphery 79 of the faceplate 64 can also be provided with a lip or raised portion so that a second cover can be place around the outer periphery of the faceplate 64. While this provides a second layer of protection to prevent water from leaking into the skimmer housing when it is not desired, the pool owner may feel additional comfort that the skimmer assembly is completely closed off during the winter months. Also, decorative covers can be installed over the faceplate 64 when the pool is in use to conceal and protect the skimmer hardware. However, in order to access the screws 73, the pool owner must remove the second cover, while the pool skimmer seal of the present invention keeps the interior of the skimmer housing free from water while necessary maintenance is performed on the fasteners 73.

While specific embodiments of the invention have been described in detail herein, it will be appreciated by those skilled in the art that various modifications and alterations may be developed in light of the overall teachings of the present invention. Presently, the embodiments discussed herein are meant to be illustrative only and not limiting as to the scope of the invention, which is to be given the full breadth of the appended claims and in any and all equivalents thereof.

What is claimed is:

1. A skimmer assembly for a pool having a sidewall with an opening therein, the skimmer assembly comprising;

a skimmer housing adapted to be mounted to an outside surface of the sidewall adjacent the opening so as to be in fluid communication with the pool;

a faceplate adapted to be secured to an inside surface of the sidewall adjacent the opening, the faceplate including an outer periphery and an inner periphery, the inner periphery being in fluid communication with the opening and the skimmer housing;

means for fastening the faceplate to the sidewall such that the faceplate is sealingly secured to the inside surface of the sidewall; and a skimmer seal for sealingly engaging the inner periphery of the faceplate whereby the skimmer housing is not in fluid communication with the pool.

2. The skimmer assembly as recited in claim 1, wherein said means for fastening comprise a plurality of screws which pan through openings in the faceplate and the sidewall and are threadingly engaged with the skimmer housing.

3. The skimmer assembly as recited in claim 2, wherein the inner periphery of the faceplate comprise a generally c-shaped sealing surface and the outer periphery of the skimmer seal comprise a rounded opening for sealingly engaging the faceplate inner periphery.

4. The skimmer assembly as recited in claim 3, wherein the inner periphery comprises a first arm generally projecting in a direction towards the skimmer housing, a second arm perpendicular thereto and a third arm generally perpendicular to the second arm such that it projects away from the skimmer housing.

5. The skimmer assembly as recited in claim 4, wherein the third arm includes a rounded portion on the end thereof.

6. The skimmer assembly as recited in claim 1, wherein the inner periphery of the faceplate comprise a generally C-shaped sealing surface and the outer periphery of the skimmer seal comprise a rounded opening for sealingly engaging the faceplate inner periphery.

7. The skimmer assembly as recited in claim 6, further comprising a lubricant applied between the faceplate inner periphery and the skimmer seal outer periphery.

8. The skimmer assembly as recited in claim 6, wherein the faceplate further comprises a notched area adjacent the inner periphery.

9. The skimmer assembly as recited in claim 1, wherein the faceplate further comprises a notched area adjacent the inner periphery.

10. The skimmer assembly as recited in claim 1, wherein the inner periphery comprises a first arm generally projecting in a direction towards the skimmer housing, a second arm perpendicular thereto and a third arm generally perpendicular to the second arm such that it projects away from the skimmer housing.

11. The skimmer assembly as recited in claim 1, wherein the inner periphery comprises an arm projecting towards the inner periphery of the faceplate and another arm generally perpendicular thereto such that it projects away from the skimmer housing.

12. The skimmer assembly as recited in claim 11, wherein said another arm includes a rounded portion on the end thereof.

13. The skimmer assembly as recited in claim 1, wherein the outer periphery of the faceplate comprises a lip adapted to engage a second cover.

14. The skimmer assembly as recited in claim 1,wherein the skimmer assembly further include a second cover attached to the outer periphery of the faceplate.

15. A faceplate for a pool skimmer assembly, the faceplate comprising:

an outer periphery;

an inner periphery defining an opening for fluid communication between the pool and the skimmer assembly; and means for securing the faceplate to a pool sidewall, wherein the inner periphery further comprises an arm projecting towards the inner periphery of the faceplate and another arm generally perpendicular thereto, wherein at least one of the arm and another arm include means for sealingly engaging a skimmer seal such that such that the pool skimmer assembly housing is not in fluid communication with the pool.

16. The faceplate as recited in claim 15, wherein said another arm includes a rounded portion on the end thereof.

17. The faceplate as recited in claim 15, wherein the faceplate further comprises a notched area adjacent the inner periphery.

18. The faceplate as recited in claim 15, wherein the faceplate further comprises a notched area adjacent the inner periphery.

19. A faceplate for a pool skimmer assembly, the faceplate comprising:

an outer periphery;

an inner periphery defining an opening for fluid communication between the pool and the skimmer assembly; and means for securing the faceplate to a pool sidewall, wherein the inner periphery further comprises a first arm generally projecting in a direction towards the skimmer housing, a second arm perpendicular thereto and a third arm generally perpendicular to the second arm such that it projects away from the skimmer housing, wherein at least one of the first, second and third arms include means for sealingly engaging a skimmer seal such that such that the pool skimmer assembly housing is not in fluid communication with the pool.

20. The faceplate as recited in claim 19, wherein the third arm includes a rounded portion on the end thereof.

* * * * *